US006897188B2

(12) United States Patent
Gohl et al.

(10) Patent No.: US 6,897,188 B2
(45) Date of Patent: May 24, 2005

(54) LIQUID CONDITIONER AND METHOD FOR WASHING TEXTILES

(75) Inventors: David W. Gohl, St. Paul, MN (US); Paul J. Mattia, Prior Lake, MN (US); Robert D. Hei, Baldwin, MN (US); John W. Birckbichler, Mendota Heights, MN (US); Richard D. Stardig, Minneapolis, MN (US)

(73) Assignee: Ecolab, Inc., St. Paul, MN (US)

( * ) Notice: Subject to any disclaimer, the term of this patent is extended or adjusted under 35 U.S.C. 154(b) by 0 days.

(21) Appl. No.: 09/907,483

(22) Filed: Jul. 17, 2001

(65) Prior Publication Data

US 2003/0064905 A1 Apr. 3, 2003

(51) Int. Cl.[7] ..... C11D 17/00

(52) U.S. Cl. ..... 510/276; 510/289; 510/290; 510/480; 510/481; 510/477; 510/499

(58) Field of Search ..... 510/276, 289, 510/290, 480, 481, 477, 499, 108, 119, 159, 421, 424, 428, 470

(56) References Cited

U.S. PATENT DOCUMENTS

| | | | | |
|---|---|---|---|---|
| 3,909,114 A | | 9/1975 | Haas et al. | |
| 4,515,704 A | | 5/1985 | Akred | |
| 4,530,780 A | | 7/1985 | van de Pas et al. | |
| 4,556,504 A | | 12/1985 | Rek | |
| 4,618,446 A | | 10/1986 | Haslop et al. | |
| 4,793,943 A | | 12/1988 | Haslop et al. | |
| 4,871,467 A | | 10/1989 | Akred et al. | |
| 4,992,194 A | | 2/1991 | Liberati et al. | |
| 5,006,273 A | | 4/1991 | Machin et al. | |
| 5,021,195 A | | 6/1991 | Machin et al. | |
| 5,073,285 A | | 12/1991 | Liberati et al. | |
| 5,108,644 A | | 4/1992 | Machin et al. | |
| 5,160,655 A | | 11/1992 | Donker et al. | |
| 5,281,356 A | | 1/1994 | Tsaur et al. | |
| 5,476,519 A | | 12/1995 | Haslop et al. | |
| 5,633,223 A | | 5/1997 | Vasudevan et al. | |
| 5,674,828 A | | 10/1997 | Knowlton et al. | |
| 5,952,285 A | * | 9/1999 | Hawkins | 510/405 |
| 5,958,852 A | | 9/1999 | Yianakopoulos et al. | |
| 5,964,692 A | | 10/1999 | Blezard et al. | |
| 6,090,762 A | * | 7/2000 | Clapperton | 510/108 |
| 6,166,095 A | | 12/2000 | Bryan et al. | |
| 6,177,396 B1 | | 1/2001 | Clapperton et al. | |
| 6,200,586 B1 | | 3/2001 | Lambie et al. | |

FOREIGN PATENT DOCUMENTS

| | | | |
|---|---|---|---|
| CA | 2023990 | AA | 2/1991 |
| CA | 2077253 | AA | 3/1993 |
| EP | 151884 | A2 | 8/1985 |
| EP | 295021 | A2 | 12/1988 |
| EP | 303473 | A2 | 2/1989 |
| EP | 354010 | A2 | 2/1990 |
| EP | 430330 | A2 | 6/1991 |
| EP | 452106 | A2 | 10/1991 |
| EP | 452 106 | A2 | 10/1991 |
| EP | 0 623 670 | A2 | 11/1994 |
| EP | 0 658 620 | A1 | 12/1994 |
| GB | 2223235 | A1 | 4/1990 |
| GB | 2304754 | A1 | 3/1997 |
| WO | WO 96/18713 | | 6/1996 |
| WO | WO 96/33254 | | 10/1996 |
| WO | WO 97/00938 | | 1/1997 |
| WO | WO 97/10321 | | 3/1997 |
| WO | WO 97/11145 | | 3/1997 |
| WO | WO/98 53131 | | 11/1998 |

OTHER PUBLICATIONS

Boltenhagen, P. et al., "Freeze–fracture observations in the L.alpha. phase of a swollen surfactant in the vicinity of the L3 and the L1 phase transitions", *J. Phys. II*, vol. 4, No. 8, pp. 1439–1448 (1994). (Abstract only), NMA.

Doerfler, H. et al., "Influence of glycerol on the formation of lyotropic mesophases–microscopic texture observations for determining preliminary diagrams of binary K–soap/glycerol systems", *Colloid Polym. Sci.* vol. 271, No. 2, pp. 173–189 (1993). (Abstract only), NMA.

Dubois, M. et al., "Phase behavior and scattering of double–chain surfactants in diluted aqueous solutions", *Langmuir*, vol. 7, No. 7, pp. 1352–1360 (1991). (Abstract only), NMA.

Porte, G. et al., "Mixed amphiphilic bilayers: bending elasticity and formation of vesicles", *J. Chem. Phys.*, vol. 102, No. 10, pp. 4290–4298 (1995). (Abstract only), NMA.

* cited by examiner

*Primary Examiner*—Necholus Ogden
(74) *Attorney, Agent, or Firm*—Merchant & Gould P.C.

(57) ABSTRACT

A liquid detergent concentrate is provided. The liquid detergent concentrate includes about 1 wt. % to about 40 wt. % combination anionic surfactant component and nonionic surfactant component containing about 0.5 wt. % to about 30 wt. % anionic surfactant and about 0.5 wt. % to about 30 wt. % nonionic surfactant, about 5 wt. % to about 60 wt. % of a water conditioning agent, and about 40 wt. % to about 95 wt. % water. The liquid detergent concentrate can be diluted with water to provide a liquid detergent use solution containing greater than 95 wt. % water. A method for washing textiles is provided.

30 Claims, 1 Drawing Sheet

LIQUID CONDITIONER AND METHOD FOR WASHING TEXTILES

FIELD OF THE INVENTION

The invention relates to a liquid conditioner concentrate, a liquid conditioner use solution, and a method for washing textiles.

BACKGROUND OF THE INVENTION

Liquid concentrates are often used in the industrial laundry industry. In general, laundry requiring cleaning is picked up, transported to a laundry cleaning facility, cleaned, and then delivered. Stains often encountered include motor oil stains and carbon black. Machines that are often used by the industrial laundry industry include 400 lb. to 600 lb. washer/extractor front-loading machines. The detergents used by the industrial laundry industry often include alkalinity and/or surfactants to help break up the stains on the laundry. In addition, the industrial laundry industry often uses conditioners that may contain phosphates.

Another commercial laundry industry that may utilize liquid concentrates can be referred to as on premise laundry (OPL). On premise laundry facilities are generally equipped to handle stains that are lighter and/or more consistent than those found on laundry cleaned in industrial laundry facilities. On premise laundry facilities are generally found in the hospitality and health care industries and are often used to clean towels, personal garments, and sheets. The types of machines used by on premise laundry facilities can include washer/extractor front-loading machines.

Textiles in the commercial laundry industry are generally cleaned by introducing a concentrate (surfactant, alkalinity, and conditioning agent) into a wash basin of a washing machine or by diluting a detergent concentrate with water via a dispenser and adding the diluted concentrate to the wash basin. The concentrate mixes with water added to the washing basin and forms a liquid use solution that contacts soiled textiles provided in the washing basin and dissolves stains present on the textiles. After the wash step (break step), the use solution is typically drained, and the textiles are rinsed. If desired, the textiles can be bleached. Another technique for washing textiles involves a suds step or a carry-over step prior to rinsing. After the washing step, the use solution is allowed to drain from the washing basin. A suds step typically involves adding additional detergent to the wash basin of the automatic washing machine after use solution drains following the wash step, and washing again. A carry-over step generally involves washing the textiles with the chemicals that remains with the textiles after the step of draining, without adding additional chemicals.

Structured liquid compositions have been developed for use in the liquid detergent industry in order to increase the loading of generally non-soluble components in the liquid composition. The term "structured surfactant" has been used to refer to pourable, fluid, non-Newtonian compositions which have the capacity physically to suspend solid particles by virtue of the presence of a surfactant mesophase or solid phase, which may be interspersed with a solvent phase. The surfactant phase can be represented as packed spherulites dispersed in the aqueous phase. Alternatively, a thin mobile lamellar phase or a bi-continuous reticular interspersion of aqueous and lamellar phases may be present. Structured liquid compositions are disclosed by, for example, European Publication No. 623,670; European Publication No. 38,101; European Publication No. 160,342; European Publication No. 104,452; U.S. Pat. No. 5,021,195; U.S. Pat. No. 5,633,223; and U.S. Pat. No. 4,244,840.

SUMMARY OF THE INVENTION

Figure 1:
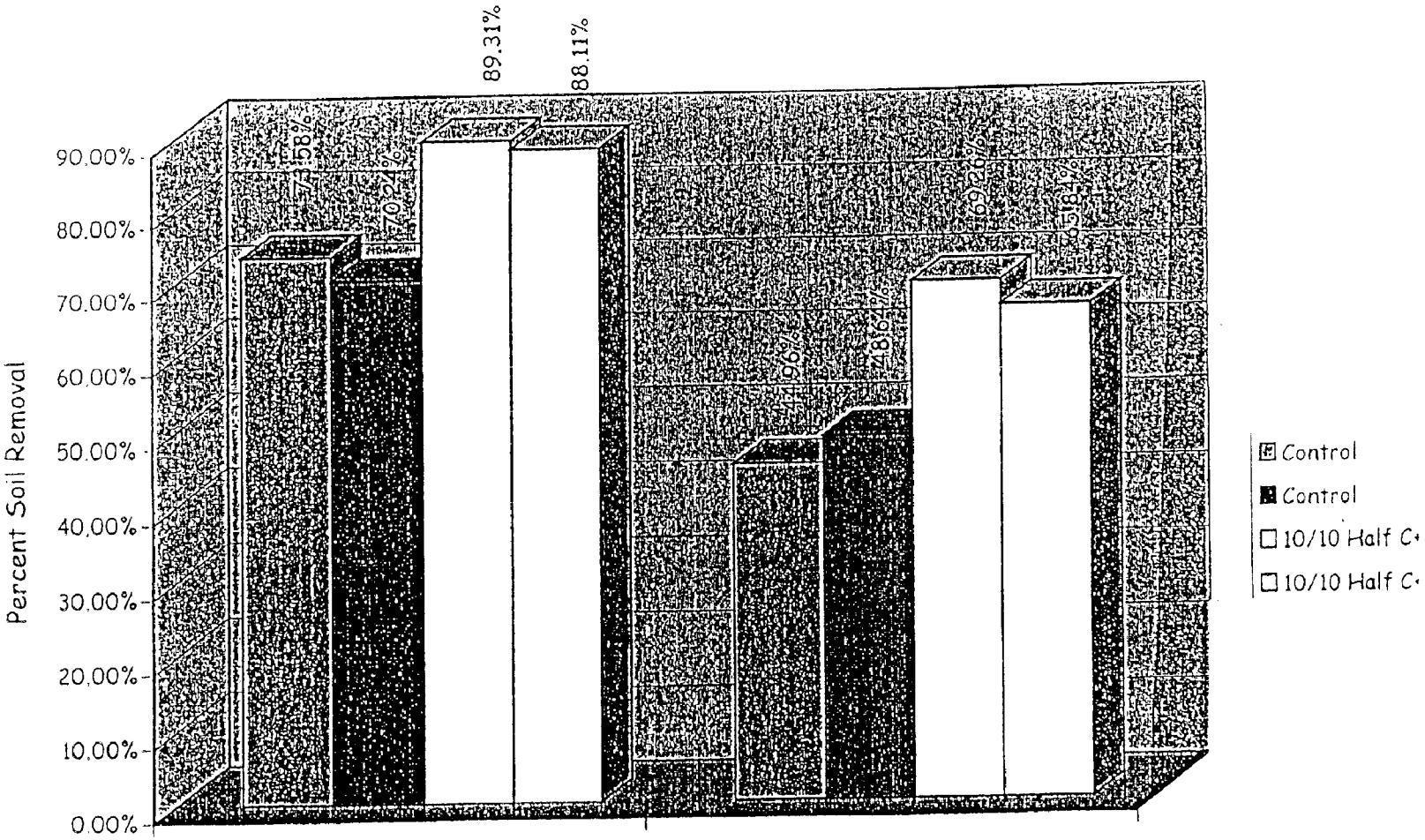
FIG. 1 is a graph showing the percent soil removal for certain types of soils according to Example 1.

A liquid conditioner concentrate is provided according to the invention. The liquid conditioner concentrate includes about 1 wt. % to about 40 wt. % of a combination of anionic surfactant component and nonionic surfactant component, about 5 wt. % to about 60 wt. % of a water conditioning agent, about 0.1 wt. % to about 10 wt. % low temperature stabilizing agent, and about 40 wt. % to about 95 wt. % water. The combination of anionic surfactant component and nonionic surfactant component is preferably provided so that the anionic surfactant component is provided in the concentrate in an amount of between about 0.5 wt. % and about 30 wt. %, the nonionic surfactant component is provided within the concentrate at a concentration of between about 0.5 wt. % and about 30 wt. %, and the weight ratio of anionic surfactant component to nonionic surfactant component is provided within a range of about 15:1 to about 1:5. Preferably, the weight ratio is provided within a range of about 10:1 to about 1:2. The combination of anionic surfactant component and nonionic surfactant component preferably provides a structured surfactant.

The anionic surfactant component preferably includes at least one of non-alkoxylated anionic surfactants, alkoxylated anionic surfactants, ethoxylated/propoxylated nonionic surfactants, amine oxides, alkyl polysaccharides, sugar ethers, betains, alkanolamides, fatty acid alkanolamides, ethoxylated alkanolamides, alkyl mercaptans, alkylene bisstearamides, ethoxylated alkanolamides, alkylene bispalmitamides, capped ethylene ethylene oxide adducts of alkylphenols, primary alky alcohols, secondary alkyl alcohols, and mixtures thereof. Exemplary anionic surfactant components include alkyl benzene sulphonates, alkyl sulfates, secondary alkane sulphonates, alpha-olefin sulphonates, alkyl sulphocarboxylates, alkyl glyceryl ether sulphonates, fatty acid monoglyceride sulphates and sulphonates, fatty acid ester sulphonates, dialkyl sulphosuccinates, primary and secondary alkane sulphonates, soaps, alkyl ether sulphates, alkyl ether carboxylates, alkyl ether phosphates, alkali-metal salts of disulfonated alkyl ethers, alkyl phenyl ether disulfonic acids, and mixtures thereof.

The nonionic surfactant preferably includes at least one of linear or branched alkyl alcohol ethoxylates, linear or branched alkyl phenol ethoxylates, and alkyl polyglucosides. Exemplary nonionic surfactant components include linear or branched alcohol ethoxylates include those having between about 1 and about 20 ethylene oxide repeating units and an alkyl group containing between about 1 and about 20 carbon atoms, linear or branched alkyl phenol ethoxylates having between about 1 and about 20 ethylene oxide repeating units and an alky group containing between about 1 and about 20 carbon atoms, and alkyl polyglucosides having an alky group containing between about 8 and about 20 carbon atoms and a degree of polymerization of between 0 and about 10. More preferably the degree of polymerization is between about 0.5 and about 8, and even more preferably between about 1 and about 5.

The water conditioning agent preferably includes at least one of sodium tripolyphosphate (STPP), ethylene diamine tetra-acetic acid (EDTA) and its salt forms, nitrilo triacetic acid (NTA), polyacrylates, phosphonates, oxalic acid and its salt form, citric acid and its salt form, zeolites, condensed phosphates, cabonates, polycarboxylates, and mixtures thereof.

The temperature stabilizing agent comprises at least one of ethanolamines, and alkyl polyglucosides. Exemplary temperature stabilizing agents include monoethanolamine, diethanolamine, and triethanolamine. Exemplary alky polyglucosides include those having an alkyl group of about 8 to about 16 carbon atoms and a degree of polymerization of between 0 and about 3, and more preferably between about 0.5 and about 3. Alkyl polyglucosides are available under the name Glucopon.

The liquid concentrate can additionally include about 0.5 wt. % to about 10 wt. % fatty soap containing an alkyl group having between about 10 and about 20 carbon atoms, cationic surfactants, amphoteric surfactants, anti-redeposition agents, optical brighteners, enzymes, dye-transfer inhibitors, alkaline agents, dyes, and fragrances.

A liquid conditioner use solution is provided according to the invention. The liquid conditioner use solution can be obtained by mixing the concentrate with water at a weight ratio of concentrate to water of at least about 1:100.

A method for washing textiles is provided according to the invention. The method includes a step of washing textiles with a first use solution during a break step in a textile washing machine, draining at least a portion of the first use solution from the textiles, and washing the textiles with a second use solution during a suds step. The first use solution and the second use solution can individually be obtained by diluting the liquid conditioner concentrate with water. Alternatively, the first use solution and the second use solution can individually be obtained from a plurality of concentrates. That is, the components of the first use solution and/or the second use solution can be provided from separate compositions that can be added together and diluted to provide the first use solution and/or the second use solution.

DETAILED DESCRIPTION OF THE INVENTION

A liquid conditioner concentrate is provided that can be diluted to provide a conditioner use solution for cleaning textiles. The liquid conditioner concentrate and the use solution according to the invention are particularly useful for removing oil/grease stains and carbon black stains from textiles. Oil/grease staining and carbon black staining are often found in textiles cleaned by commercial laundry facilities and can be cleaned by the liquid detergent composition of the invention. Additional staining that can be addressed by the liquid conditioner composition of the invention includes wax, paint, tar, blood, clay, food, body soils, sebum, fats, makeup, lipstick, wine, coffee, tea, and grass. It should be understood that the term "textiles" refers to articles of clothing or fabric that are commonly characterized as laundry and washed at industrial laundry facilities and on premise laundry facilities. Examples of commonly washed textiles include shirts, pants, overalls, towels, sheets, chef coats, shop towels, ink towels, bar towels, Nomex, executive shirts, executive pants, laboratory coats, knit shirts, dust mops, fender covers, continuous roll-towels (CRT), mats, meat frocks, food-service whites, blankets, reusable gowns, diapers, operating room garments, table linen, napkins, incontinent pads, hamper bags, examination gowns, and washcloths.

The liquid conditioner concentrate and the liquid conditioner use solution are intended to be used for washing textiles in an automatic clothes washing machine. It should be understood that an automatic clothes washing machine refers to any of the conventional clothes washing machines used in industrial washing facilities, on premise washing facilities, and in residences (home-style washing machines). Washing machines that can be used according to the invention provide for a wash cycle having a wash step (break step) followed by a rinse step or steps, or a wash step followed by a suds step and a rinse step or steps. The liquid conditioner use solution can refer to the use solution provided during the wash step (break step) or it can refer to the use solution provided during the suds step.

The liquid conditioner concentrate can be referred to more simply herein as the concentrate, and the liquid conditioner use solution can be referred to more simply as the use solution. In general, the difference between the liquid conditioner concentrate and the liquid conditioner use solution is a result of a higher concentration of water provided in the liquid conditioner use solution.

The liquid conditioner concentrate according to the invention is preferably diluted with water to provide the use solution. The active level of the use solution depends on several factors, including, the type of soil to be cleaned, the level of soiling on the textile, and the type of active ingredient provided in the detergent use solution. The term "active level" refers to the components of the use solution other than water. In the case of a break step, the use solution will likely include active ingredients as result of the liquid conditioner concentrate, the alkali (if present) and the detergent (if present) used. In general, it is expected that the liquid conditioner concentrate will be diluted to provide a use solution containing an active level of between about 200 ppm and about 5,000 ppm resulting from the liquid conditioner concentrate.

It is expected that the liquid conditioner concentrate will be diluted for dispensing into a washing machine. Once in the machine, the diluted concentrate will be further diluted to provide the conditioner use solution having the desired active level. It is desirable to minimize the amount of water provided in the liquid conditioner concentrate in order to minimize shipping costs associated with shipping water. Because of the high concentration of active ingredients in the conditioner concentrate, it is often desirable to dilute the concentrate so that it has a lower viscosity and provides better flow through washing machine dispensing equipment. It should be understood that the conditioner concentrate should not be so concentrated that it loses stability. If the concentrate is too concentrated, it may be too viscous to flow through many commercial washing machine dispensing systems. In most applications, it is expected that the concentrate will be diluted with water at a weight ratio range of liquid concentrate to water of between about 1:1 and about 1:10, and more preferably between about 1:4 and about 1:5, to provide a concentrate that can sufficiently flow through washing machine dispensing equipment. Once the diluted concentrate is introduced into the washing machine, it is expected that it will be further diluted with water to provide the desired active level. In many applications, it is expected that this dilution will be provided by diluting the diluted concentrate with water at a weight ratio of diluted concentrate to water of between about 1:100 and about 1:2000. It should be understood that the diluted concentrate is considered a concentrate as long as the amount of water in the composition is less than 95 wt. %

The liquid conditioner concentrate preferably contains a combination of anionic surfactant, nonionic surfactant, conditioning agent, and water. More preferably, the liquid conditioner concentrate includes a low temperature stabilizer. The combination of anionic surfactant and nonionic surfactant is preferably provided so that the combination of the anionic surfactant and nonionic surfactant can be referred to as a "structured surfactant." It is believed that the "structured surfactant" can be represented as packed spherulites dispersed in an aqueous phase. The structured surfactant is particularly useful for loading or suspending solid particles. The structured liquid compositions are disclosed by, for example, European Publication No. 623,670; European Publication No. 38,101; European Publication No. 160,342; European Publication No. 104,452; U.S. Pat. No. 5,021,195; U.S. Pat. No. 5,633,223; and U.S. Pat. No. 4,244,840. The disclosures of these references are incorporated herein by reference for their disclosures on obtaining structured surfactants. Additional components that can be incorporated into the liquid conditioner concentrate according to the invention include fatty acid soaps, cationic surfactants, amphoteric surfactants, anti-redeposition agents, optical brighteners, bleach activators, enzymes, dye-transfer inhibitors, alkaline agents, dyes, and fragrances.

The anionic surfactant component and the nonionic surfactant component are provided in the liquid concentrate according to the invention in an amount sufficient to provide a desired level of loading of solid conditioning agent. It is believed that the combination of the anionic surfactant component and the nonionic surfactant component will provide a structured liquid that helps maintain the loading of the conditioning agent. Accordingly, the amounts of anionic surfactant component and nonionic surfactant component are controlled to provide a desired level of conditioning agent loading in the concentrate. Accordingly, the amount of anionic surfactant component to nonionic surfactant component is preferably provided within a weight ratio range of about 15:1 to about 1:5, and more preferably between about 10:1 and about 1:2.

It is believed that the anionic surfactant component and the nonionic surfactant component will provide detersive properties. It is believed that too much surfactant may cause an undesirable amount of foaming. In addition, it is expected that too much of the surfactant component will result in a liquid concentrate having a viscosity that is too high to allow sufficient flow through dispensing equipment. Preferably, the combination of the anionic surfactant component and the nonionic surfactant component is provided within the liquid concentrate in a range of between about 1 wt. % and about 40 wt. %.

Preferred anionic surfactants that can be used according to the invention include non-alkoxylated anionic surfactants and alkoxylated anionic surfactants. Exemplary non-alkoxylated anionic surfactants include alkyl benzene sulphonates, alkyl sulfates, alpha-olefin sulphonates, alkyl sulphocarboxylates, alkyl glyceryl ether sulphonates, fatty acid monoglyceride sulphates and sulphonates, fatty acid ester sulphonates, dialkyl sulphosuccinates, primary and secondary alkane sulphonates, and soaps. Exemplary alkoxylated anionic surfactants include alkyl ether sulphates, alkyl ether carboxylates, alkyl ether phosphates, alkali-metal salts of disulfonated alkyl ethers (including surfactants available under the name Dowfax and similar surfactants), alkyl phenyl ether disulfonic acids, and mixtures thereof. The anionic surfactant component is preferably provided in the liquid concentrate in an amount of between about 0.5 wt. % and about 30 wt. %.

Preferred nonionic surfactants that can be used according to the invention include linear or branched alkyl alcohol ethoxylates, linear or branched alkyl phenol ethoxylates, alkyl polyglucosides, ethoxylated/propoxylated nonionic surfactants, amine oxides, alkyl polysaccharides, sugar ethers, betains, alkanolamides, fatty acid alkanolamides, ethoxylated alkanolamides, alkyl mercaptans, alkylene bisstearamides, ethoxylated alkanolamides, alkylene bispalmitamides, capped ethylene ethylene oxide adducts of alkylphenols, primary alky alcohols, secondary alkyl alcohols, and mixtures thereof. Preferred linear or branched alcohol ethoxylates include those having between about 1 and about 20 ethylene oxide repeating units and an alkyl group containing between about 1 and about 20 carbon atoms, and more preferably between about 1 and about 5 ethylene oxide repeating units and an alkyl group containing between about 10 and about 15 carbon atoms. Preferred linear or branched alkyl phenol ethoxylates include those having between about 1 and about 20 ethylene oxide repeating units and an alky group containing between about 1 and about 20 carbon atoms, and more preferably between about 1 and about 5 ethylene oxide repeating units and an alkyl group containing between about 10 and about 15 carbon atoms. Preferred linear or branched alkyl alcohol ethoxylates and linear or branched alkyl phenol ethoxylates include those having a branched alkyl group containing 9 carbon atoms. Preferred alkyl polyglucosides include those having an alky group containing between about 8 and about 20 carbon atoms and a degree of polymerization of between 0 and about 10. More preferably the degree of polymerization is between about 0.5 and about 8, and even more preferably between about 1 and about 5. The liquid concentrate preferably includes the nonionic surfactant component in an amount of between about 0.5 wt. % and about 30 wt. %. Preferred ethoxylated/propoxylated nonionic surfactants include those having about 1 to about 100 ethylene oxide repeating units and about 1 to about 100 propylene oxide repeating units, and more preferably between about 1 and about 50 ethylene oxide repeating units and about 1 to about 50 propylene oxide repeating units.

The liquid concentrate preferably includes a temperature stabilizer in an amount sufficient to maintain the stability of the liquid detergent concentrate at a temperature as low as 40° F. for at least 4 weeks, and preferably within the range of 40° F. and 120° F. It should be understood that stability of the concentrate reflects the ability of the concentrate to resist phase separation. According to the invention, a liquid concentrate is not stable if the liquid detergent concentrate forms a separate phase or layer that contains at least 5% of the volume of the liquid concentrate. It is common for a liquid concentrate according to the invention to form a skim layer at the top of the liquid concentrate that represents less than 5% of the total volume of the liquid concentrate. The formation of a skim layer does not demonstrate a lack of stability of the liquid concentrate. The liquid concentrate preferably includes an amount of low temperature stabilizer of between about 0.1 wt. % and about 10 wt. %.

Exemplary low temperature stabilizers that can be used according to the invention include ethanolamines and alkyl polyglucosides. Preferred low temperature stabilizers are those that are provided as a liquid at room temperature. Preferred ethanolamines include monoethanolamine, diethanolamine, and triethanolamine. Exemplary alky polyglucosides include those having an alkyl group of about 8 to about 16 carbon atoms and a degree of polymerization of between 0 and about 3, and more preferably between about 0.5 and about 3. The low temperature stabilizer component is preferably provided in the liquid concentrate in a range of between about 0.1 wt. % and about 10 wt. %. When the low temperature stabilizer is an ethanolamine, it is preferably provided in an amount of between about 0.5 wt. % and about 10 wt. %. When the low temperature stabilizer is an alkyl polyglucoside, it is preferably provided in an amount of between about 0.1 wt. % and about 5 wt. %.

The liquid concentrate includes a water conditioning agent. In general, the water conditioning agent includes any component that chelates or binds calcium or magnesium ions in water. The purpose of the conditioning agent is to bind the ions that have a tendency to react with surfactants and make the surfactants less effective. Certain conditioning agents may be referred to as anti-redeposition agents because of their tendency to help reduce soil redeposition. Certain large molecules act as anti-redeposition agents by trapping soil within the molecule and thereby assisting in cleaning performance. Exemplary water conditioning agents that can be used according to the invention include sodium tripolyphosphate (STPP), ethylene diamine tetra-acetic acid (EDTA), nitrilo triacetic acid (NTA), polyacrylates, phosphonates, oxalic acid, citric acid, zeolites, condensed phosphates, cabonates, polycarboxylates, and mixtures thereof. Additional water conditioning agents that can be used include the salt forms of the acid water conditioning agents.

The water conditioning agent used in the liquid concentrate according to the invention preferably have a size that allows it to be suspended. In general, smaller particles are easier to suspend than larger particles. A preferred size is between about 1 micron and about 300 microns, and more preferably between about 50 microns and about 150 microns.

The use of a structured surfactant allows for providing more of the water conditioning agent into the concentrate than the soluble amount of water conditioning agent. The water conditioning agents used in the liquid concentrate according to the invention are preferably provided in an amount greater than about 5.0 wt. %, more preferably greater than about 10 wt. %, and even more preferably in an amount greater than about 15 wt. %. In general, water conditioning agents are used in an amount up to about 60 wt. %. A preferred range of water conditioning agent in the liquid concentrate according to the invention is between about 20 wt. % and about 50 wt. %. In most applications, it is expected that these ranges of water conditioning agents are based upon a total surfactant concentration (anionic surfactant component and nonionic surfactant component) of between about 1 wt. % and about 40 wt. %. The amount of combination of anionic and nonionic surfactant to water conditioning agent is preferably between about 3:1 to about 1:10, and more preferably between about 1:1 and about 1:8. It is believed that for prior art detergent compositions, if a water conditioning agent is included, it is included at a ratio of surfactant to water conditioning agent that is higher than the range according to the invention.

The liquid concentrate preferably includes water in an amount to maintain the concentrate in a liquid form and to maintain stability (resist phase separation). Preferably, the amount of water provided in the liquid detergent concentrate is between about 40 wt. % and about 95 wt. %. It should be understood that once the water concentration exceeds 95 wt. %, the composition can be considered a use solution.

The liquid concentrate preferably includes a fatty acid soap for boosting performance. Preferred fatty acid soaps that can be used according to the invention include those soaps having a saturated or unsaturated alkyl chain of between about 10 carbon atoms and about 20 carbon atoms, and more preferably between about 12 and about 18 carbon atoms. It should be understood that the fatty acid soap is not a required component of the liquid concentrate according to the invention. If the fatty soap is present in the liquid concentrate according to the invention, it is preferably provided in an amount sufficient to provide a benefit but should not be present in too high an amount that additional increase in performance is not observed. In addition, it is expected that too much fatty soap may increase the cost of the liquid concentrate and result in a reduction of other components in the liquid concentrate. If the fatty acid soap is used, it is preferably provided in the liquid concentrate in an amount of between about 0.5 wt. % and about 10 wt. %.

Exemplary fatty acid soaps that can be used according to the invention include capric acid, lauric acid, myristic acid, palmitic acid, stearic acid, oleic acid, linoleic acid, linolenic acid, and mixtures thereof. It should be understood that naturally occurring mixtures of fatty acid soaps can be used including tall oil, coconut oil, and palm oil.

The liquid concentrate according to the invention can include amphoteric surfactants. In general, it is expected that the amphoteric surfactants will be provided to enhance detersive performance. Exemplary amphoteric surfactants that can be incorporated into the conditioner composition include dicarboxylic coconut derivative salts such as alkyl imidazolimium dicarboxylate sodium salt, betaines, sulphobetaines, phosphobetaines, and mixtures thereof. Preferably, the amount of amphoteric surfactant provided in the liquid concentrate is between 0 and about 5 wt. %, and more preferably between about 0.5 wt. % and about 5 wt. %.

Exemplary cationic surfactants that can be used include those commonly used as fabric softeners. Additional cationic surfactants include alkyl quaternary ammonium and alkyl/benzyl quaternary ammonium, and mixtures thereof wherein the alkyl group contains between about 10 and about 22 carbon atoms. The cationic surfactant can be used in an amount of between 0 and about 5 wt. % and more preferably between about 0.5 wt. % and about 5 wt. %.

Exemplary bleach activators that can be used include N,N,N',N'-tetraacetylethylene diamine (TAED), para-acetoxybenzenesulfonates, triacetylcyanurates, acetylimidazoles, benzoylimidazoles, acetyltriethyl citrates, alkali metal arylbenzoates, and mixtures thereof. The bleach activators, when used, are preferably used in an amount of between about 1 wt. % and about 15 wt. %.

Exemplary enzymes that can be used according to the invention include protease, amylase, cellulase, oxidase, lipase, and mixtures thereof. When used, the enzymes are preferably used in an amount of between about 0.5 wt. % and about 1 wt. %.

An exemplary dye-transfer agent that can be used according to the invention includes polyvinyl pyrrolidone. When used, the dye-transfer agent is preferably used in an amount of between about 0.5 wt. % and about 1 wt. %. When an anti-redeposition agent is used, it is preferably used in an amount of between about 0.5 wt. % and about 5 wt. %.

Textiles are often washed according to the invention by a one step or two step washing technique. In general, a one step washing technique involves adding washing components to the wash basin of an automatic washing machine, diluting the washing components to provide a use solution, and washing textiles provided in the washing machine. After the washing step, the use solution is allowed to drain and the textiles are rinsed with one or more rinsing steps. There may be an additional sour step if an alkali component was used as part of the washing components. The two step process involves washing textiles according to the one step process, but after draining the use solution after the wash step, a liquid conditioner concentrate is added to the wash basin to provide a second use solution for washing the textiles. It is believed that by removing the first use solution from the wash basin, much of the soil loading can be removed, and that this provides the second use solution with an ability to penetrate to the soil surface layer that actually contacts the textiles to help remove staining caused by the soil. It is believed that the wash step removes much of the bulk soil and that the suds step removes much of the surface layer staining.

The Applicants have found that by splitting the conditioning composition between the break step and a suds step, enhanced cleaning can be obtained. An advantage of the invention relates to the ability to use a determined amount of conditioning composition according to the invention in both the break step and the suds step and achieve enhanced cleaning compared to the use of the same amount of the conditioning composition in the break step.

The washing components in a typical washing step or break step includes at least one of an alkali component, a detergent component, and a conditioner component. In many applications, all three components are used together. Preferably, the liquid use solution used in the washing step or break step according to the invention is a combination of alkali component, detergent component, and conditioner component. The alkali component and the detergent component are commercially available. The conditioner component is the liquid conditioner composition according to the invention. The components can be added as concentrates and then diluted. The use solution for use in the break step preferably includes a surfactant concentration of between about 500 ppm and about 5,500 ppm, an alkali level of about 0 to about 1,300 ppm (ppm of active alkalinity as % $Na_2O$) and preferably between about 500 ppm and about 1,000 ppm, and conditioning agent at a concentration of between about 300 ppm and about 3,100 ppm.

When the suds step is practiced according to the invention, the liquid conditioner concentrate according to the invention is preferably added and diluted to provide a second use solution. The second use solution preferably includes a surfactant concentration of between about 100 ppm and about 2,000 ppm and a conditioning agent concentration of between about 300 ppm and about 3,000 ppm.

It should be understood that the concentration of surfactant, conditioning agent, and alkali provided in the first use solution and the concentration of surfactant and conditioning agent provided in the second use solution depend on the level of soil of the textiles to be washed and the water conditions of the water available for washing.

The liquid conditioner concentrate is preferably used in the break step at an ounce concentrate per 100 pounds of linen (Oz/cwf) of at least 1. It should be understood that the liquid conditioner concentrate can be used at a level of between 0 and about 30, and more preferably between about 1 and about 30. If the water used in the break step is sufficiently good (lack of hardness), it may be possible to avoid using the liquid conditioner concentrate in the break step. If the staining is light, it may be desirable to use about 3 to about 8 Oz/cwf of conditioner. If the staining is medium, it may be desirable to use about 7 to about 15 Oz/cwf of conditioner. If the staining is heavy, it may be desirable to use about 14 to about 23 Oz/cwf of conditioner. In most applications, it is expected that the break step will utilize 0 to about 40 Oz/cwf of alkali, and about 5 to about 30 Oz/cwf of detergent.

When the conditioner according to the invention is used in the suds step, it is preferably used in an amount that provides for soil removal but not too much that foaming becomes a problem. It is believed that foaming is more of a problem in the suds step than in the bread step because of the presence of more soil in the break step having an effect of reducing foaming. Preferably, the conditioner is used in the suds step to provide a level of at least about 1 Oz/cwf, more preferably between about 1 and about 15 Oz/cwf, and even more preferably between about 2 and about 12 Oz/cwf.

It should be understood that the components of the use solution used in the break step and the components of the use solution used in the suds step can be obtained from different sources. It is expected that the break step may include a use solution obtained from a detergent, a conditioner, and an alkali; from a detergent and a conditioner; from a detergent and an alkali; or from a conditioner and an alkali. In addition, other components can be added to the break step. The conditioner can be used alone or with other components in the suds step. Furthermore, the use solution of the suds step can be obtained from the liquid conditioner concentrate according to the invention or it can be obtained from other components. According to the invention, it is desirable to provide a level of conditioning agent in the suds step that enhances the removal of soils compared with the absence of conditioning agent. It should be understood that the weight percents reported for the "concentrate or plurality of concenterates" is for the total amount of the concentrate(s).

The following examples will demonstrate the present invention, but should not be construed as limiting the present invention.

EXAMPLE 1

The applicants discovered that the conditioning composition according to the invention, when split between the wash step and a subsequent suds step, enhanced cleaning performance can be achieved compared with the use of the same amount of conditioning composition in the wash step without a suds step.

Exemplary one step and two step processes for washing textiles in commercial textile washing machines are described below in Table 1. The alkali component, the detergent component, and the conditioner component described in the one step process are commercially available. The alkali component is available under the name TurboMax from Ecolab, Inc. of St. Paul, Minn. The detergent component is available under the name TurboFlexD from Ecolab, Inc. The conditioner component is available under the name TurboFlexC from Ecolab, Inc. of St. Paul, Minn. The component identified as Composition A is a composition according to the invention. A representative formulation of Composition A is provided in Table 2.

Two types of textiles were tested. Both types of textile included relatively clean shirts and soiled swatches. The first type of material included swatches soiled with motor oil (DMO) and the second type of material included swatches soiled with motor oil and carbon black (DMO-CB). The tests were run in a 35 lb machine and used an 80% fill rate to provide 28 lb linen. Percent soil removal was determined by measuring light reflectance of washed and unwashed swatches according to ASTM E 313.

For each type of soiled material, two tests were run according to the one step process and two tests were run according to the two step process. The results are reported in FIG. 1.

TABLE 1

| One Step and Two Step Processes | | | | |
|---|---|---|---|---|
| | Product | TIME (Min) | WASH TEMP (° F.) | Oz/cwt |
| A. One Step (Break) Wash Process: | | | | |
| Break Step | Alkali | 15 | 145 | 30 |
| | Detergent | | | 20 |
| | Conditioner | | | 20 |
| Carry-over Step | | 10 | 145 | 0 |
| Rinse Step | | 2 | 145 | 0 |
| Rinse Step | | 2 | 130 | 0 |
| Rinse Step | | 2 | 110 | 0 |
| Sour Step | Sour Product | 5 | 90 | 2 |
| Extract Step | | 2 | | |
| B. Two Step (Break/Suds) Wash Process: | | | | |
| Break Step | Alkali | 15 | 145 | 30 |
| | Detergent | | | 20 |
| | Composition A | | | 10 |
| Suds Step | Composition A | 10 | 145 | 10 |
| Rinse Step | | 2 | 145 | 0 |
| Rinse Step | | 2 | 130 | 0 |
| Rinse Step | | 2 | 110 | 0 |
| Sour Step | Sour Product | 5 | 90 | 2 |
| Extract Step | | 2 | | |

TABLE 2

| Conditioner Concentrate Formulation | | |
|---|---|---|
| Component | Range (wt. %) | Preferred Range (wt. %) |
| Anionic Surfactant | 0.5–30 | 2–10 |
| Nonionic Surfactant | 0.5–30 | 1–10 |
| Fatty Acid Soap | 0–10 | 2–5 |
| Conditioning Agent | 5–60 | 10–30 |
| Water | 40–95 | 45–60 |

TABLE 2-continued

| Conditioner Concentrate Formulation | | |
|---|---|---|
| Component | Range (wt. %) | Preferred Range (wt. %) |
| Dye | 0–1 | 0.01–0.1 |
| Low Temperature Stabilizer | 0.1–10 | 1–5 |

EXAMPLE 2

The low temperature stability and viscosity of three compositions were compared. The first composition can be referred to as Formulation 1 and has the components identified in Table 3. Formulation 2 is identical to Formulation 1 except that the tall oil fatty acid and part of the water of Formulation 1 is replaced with additional sodium tripolyphosphate. Formulation 3 is identical to Formulation 1 except that it contains 1.6 wt. % triethanolamine in place of 1.6 wt. % water. The sodium tripolyphosphate component is provided as a mixture, and the mixture is identified in Table 3 by the ratio of the two identified sodium tripolyphosphate components. The results of the test are reported in Table 4.

TABLE 3

| Formulation 1 | |
|---|---|
| Component | Amount |
| Water | balance |
| anionic surfactant blend | 6.5 |
| nonionic surfactant | 0.6 |
| STPP powder | 34.1 |
| low temperature stabilizer | 1.6 |
| dye | 0.015 |
| defoamer | 0.3 |

TABLE 4

| Formula | Wt. % Tall Oil | Wt. % STPP | Wt. % TEA | Viscosity - Days Old (cps - 50 rpm) 0 | 1 | 3 | 5 | 7 | 9 | 14 | 21 |
|---|---|---|---|---|---|---|---|---|---|---|---|
| Formulation 1 | 3.0 | 35.8 | 0.0 | 558 | 850 | | 820 | | 932 | 1080 | |
| Formulation 2 | 0.0 | 41.1 | 0.0 | 400 | | 580 | 568 | | | 586 | 586 |
| Formulation 3 | 3.0 | 35.8 | 1.6 | 448 | 754 | | | 774 | 764 | 836 | 850 |
| Formulation 3 | 3.0 | 35.8 | 1.6 | 664 | 624 | | | 792 | | 576 | 586 |

| Formula | Viscosity - Days Old (cps - 50 rpm) 28 | 42 | 56 | 40° Stability - Days Old 1 | 3 | 5 | 7 | 9 | 11 | 14 | 21 | 28 |
|---|---|---|---|---|---|---|---|---|---|---|---|---|
| Formulation 1 | 1360 | 1540 | 1750 | | | | N | N | N | N | N | N |
| Formulation 2 | | | | | | S | | | | S | | |
| Formulation 3 | 880 | 908 | | Y | | | | | S | S | S | S |
| Formulation 3 | | | | | | | S | | | | S | |

N = Not stable - phase separation
S = Skim layer - less than 5% of volume as top layer
Y = No layer on top

We claim:

1. A liquid conditioner concentrate comprising:

(a) about 1 wt. % to about 40 wt. % of a combination of anionic surfactant component and nonionic surfactant component, wherein:

(i) the anionic surfactant component is provided in the concentrate in an amount of between about 0.5 wt. % and about 30 wt. %;

(ii) the nonionic surfactant component is provided within the concentrate at a concentration of between about 0.5 wt. % and about 30 wt. %; and (iii) the weight ratio of the anionic surfactant component to the nonionic surfactant component is provided within a range of about 15:1 to about 1:5;

(b) about 20 wt. % to about 60 wt. % of a water conditioning agent; wherein the ratio of the combination of anionic surfactant component and nonionic surfactant component to the water conditioning agent is between about 3:1 and about 1:10, wherein the water conditioning agent comprises at least one of sodium tripolyphosphate (STPP), ethylene diamine tetra-acetic acid (EDTA), salt of ethylene diamine tetra-acetic acid, nitrilo triacetic acid (NTA), polyacrylates, phosphonates, oxalic acid, salt of oxalic acid, citric acid, salt of citric acid, zeolites, condensed phosphates, carbonates, polycarboxylates, and mixtures thereof;

(c) about 0.1 wt. % to about 10 wt. % low temperature stabilizing agent comprising ethanolamine, wherein the low temperature stabilizing agent is provided in an amount sufficient to maintain stability of the liquid conditioner concentrate at a temperature as low as 40° F. for at least 4 weeks wherein stability is exhibited by a separate phase or layer that, if present, contains less then 5% of the total volume of the liquid conditioner concentrate;

(d) about 40 wt. % to about 95 wt. % water; and (e) about 0.5 wt. % to about 10 wt. % fatty soap containing an alkyl group having between about 10 and about 20 carbon atoms;

wherein the liquid conditioner concentrate is constructed for washing textiles in an automatic clothes washing machine.

2. A liquid conditioner concentrate according to claim 1, wherein the combination of anionic surfactant component and nonionic surfactant component provides a structured surfactant.

3. A liquid conditioner concentrate according to claim 1, wherein the anionic surfactant component comprises at least one of non-alkoxylated anionic surfactants and alkoxylated anionic surfactants.

4. A liquid conditioner concentrate according to claim 1, wherein the anionic surfactant component comprises at least one of alkyl benzene sulphonates, alkyl sulfates, secondary alkane sulphonates, alpha-olefin sulphonates, alkyl sulphocarboxylates, alkyl glyceryl ether sulphonates, fatty acid monoglyceride sulphates and sulphonates, fatty acid ester sulphonates, dialkyl sulphosuccinates, primary and secondary alkane sulphonates, soaps, alkyl ether sulphates, alkyl ether carboxylates, alkyl ether phosphates, alkali-metal salts of disulfonated alkyl ethers, alkyl phenyl ether disulfonic acids, and mixtures thereof.

5. A liquid conditioner concentrate according to claim 1, wherein the nonionic surfactant component comprises at least one of linear or branched alkyl alcohol ethoxylates, linear or branched alkyl phenol ethoxylates, alkyl polyglucosides, ethoxylated/propoxylated nonionic surfactants, amine oxides, alkyl polysaccharides, sugar ethers, betains, alkanolamides, fatty acid alkanolamides, ethoxylated alkanolamides, alkyl mercaptans, alkylene bisstearamides, ethoxylated alkanolamides, alkylene bispalmitamides, capped ethylene oxide adducts of alkylphenols, primary alky alcohols, secondary alkyl alcohols, and mixtures thereof.

6. A liquid conditioner concentrate according to claim 5, wherein the linear or branched alcohol ethoxylates include those having between about 1 and about 20 ethylene oxide repeating units and an alkyl group containing between about 1 and about 20 carbon atoms, the linear or branched alkyl phenol ethoxylates include those having between about 1 and about 20 ethylene oxide repeating units and an alky group containing between about 1 and about 20 carbon atoms, and the alkyl polyglucosides include those having an alky group containing between about 8 and about 20 carbon atoms and a degree of polymerization of between 0 and about 10.

7. A liquid conditioner concentrate according to claim 1, wherein the low temperature stabilizing agent comprises at least one of monoethanolamine, diethanolamine, and triethanolamine.

8. A liquid conditioner concentrate according to claim 1, further comprising:

(a) at least one of cationic surfactants, amphoteric surfactants, anti-redeposition agents, optical brighteners, bleach activators, enzymes, dye-transfer inhibitors, alkaline agents, dyes, and fragrances.

9. A conditioner use solution prepared by mixing a liquid conditioner concentrate with water at a weight ratio of liquid conditioner to water of at least 1:100, the liquid conditioner concentrate comprising:

(a) about 1 wt. % to about 40 wt. % of a combination of anionic surfactant component and nonionic surfactant component, wherein:

(i) the anionic surfactant component is provided in the concentrate in an amount of between about 0.5 wt. % and about 30 wt. %;

(ii) the nonionic surfactant component is provided within the concentrate at a concentration of between about 0.5 wt. % and about 30 wt. %; and (iii) the weight ratio of the anionic surfactant component to the nonionic surfactant component is provided within a range of about 15:1 to about 1:5;

(b) about 20 wt. % to about 60 wt. % of a water conditioning agent wherein the ratio of the combination of anionic surfactant component and nonionic surfactant component to the water conditioning agent is between about 3:1 and about 1:10, wherein the water conditioning agent comprises at least one of sodium tripolyphosphate (STPP), ethylene diamine tetra-acetic acid (EDTA), salt of ethylene diamine tetra-acetic acid, nitrilo triacetic acid (NTA), polyacrylates, phosphonates, oxalic acid, salt of oxalic acid, citric acid, salt of citric acid, zeolites, condensed phosphates, carbonates, polycarboxylates, and mixtures thereof;

(c) about 0.1 wt. % to about 10 wt. % low temperature stabilizing agent comprising ethanolamine, wherein the low temperature stabilizing agent is provided in an amount sufficient to maintain stability of the liquid conditioner concentrate at a temperature as low as 40° F. for at least 4 weeks wherein stability is exhibited by a separate phase or layer that, if present, contains less then 5% of the total volume of the liquid conditioner concentrate;

(d) about 40 wt. % to about 95 wt. % water; and (e) about 0.5 wt. % to about 10 wt. % fatty soap containing an alkyl group having between about 10 and about 20 carbon atoms;

wherein the liquid conditioner concentrate is constructed for washing textiles in an automatic clothes washing machine.

10. A conditioner use solution according to claim 9, wherein the combination of anionic surfactant component and nonionic surfactant component provides a structured surfactant.

11. A conditioner use solution according to claim 9, wherein the anionic surfactant component comprises at least one of non-alkoxylated anionic surfactants and alkoxylated anionic surfactants.

12. A conditioner use solution according to claim 9, wherein the anionic surfactant component comprises at least one of alkyl benzene sulphonates, alkyl sulfates, secondary alkane sulphonates, alpha-olefin sulphonates, alkyl sulphocarboxylates, alkyl glyceryl ether sulphonates, fatty acid monoglyceride sulphates and sulphonates, fatty acid ester sulphonates, dialkyl sulphosuccinates, primary and secondary alkane sulphonates, soaps, alkyl ether sulphates, alkyl ether carboxylates, alkyl ether phosphates, alkali-metal salts of disulfonated alkyl ethers, alkyl phenyl ether disulfonic acids, and mixtures thereof.

13. A conditioner use solution according to claim 9, wherein the nonionic surfactant component comprises at least one of linear or branched alkyl alcohol ethoxylates, linear or branched alkyl phenol ethoxylates, alkyl polyglucosides, ethoxylated/propoxylated nonionic surfactants, amine oxides, alkyl polysaccharides, sugar ethers, betains, alkanolamides, fatty acid alkanolamides, ethoxylated alkanolamides, alkyl mercaptans, alkylene bisstearamides, ethoxylated alkanolamides, alkylene bis-palmitamides, capped ethylene oxide adducts of alkylphenols, primary alky alcohols, secondary alkyl alcohols, and mixtures thereof.

14. A conditioner use solution according to claim 13, wherein the linear or branched alcohol ethoxylates include those having between about 1 and about 20 ethylene oxide repeating units and an alkyl group containing between about 1 and about 20 carbon atoms, the linear or branched alkyl phenol ethoxylates include those having between about 1 and about 20 ethylene oxide repeating units and an alky group containing between about 1 and about 20 carbon atoms, and the alkyl polyglucosides include those having an alky group containing between about 8 and about 20 carbon atoms and a degree of polymerization of between 0 and about 10.

15. A conditioner use solution according to claim 9, wherein the low temperature stabilizing agent comprises at least one of monoethanolamine, diethanolamine, and triethanolamine.

16. A conditioner use solution according to claim 9, wherein the concentrate further comprises:

(a) at least one of cationic surfactants, amphoteric surfactants, anti-redeposition agents, optical brighteners, enzymes, dye-transfer inhibitors, alkaline agents, dyes, and fragrances.

17. A method for washing textiles, the method comprising steps of:

(a) washing textiles with a first use solution in a textile washing machine;

(b) draining at least a portion of the first use solution from the textiles; and (c) washing the textiles with a second use solution, the first use solution and the second use solution comprising a result of diluting a concentrate comprising:

(1) about 1 wt. % to about 40 wt. % of a combination of anionic surfactant component and nonionic surfactant component, wherein:

(A) the anionic surfactant component is provided in the concentrate in an amount of between about 0.5 wt. % and about 30 wt. %;

(B) the nonionic surfactant component is provided within the concentrate at a concentration of between about 0.5 wt. % and about 30 wt. %; and (C) the weight ratio of the anionic surfactant component to the nonionic surfactant component is provided within a range of about 15:1 to about 1:5;

(2) about 20 wt. % to about 60 wt. % of a water conditioning agent;

wherein the ratio of the combination of anionic surfactant component and nonionic surfactant component to the water conditioning agent is between about 3:1 and about 1:10, wherein the water conditioning agent comprises at least one of sodium tripolyphosphate (STPP), ethylene diamine tetra-acetic acid (EDTA), salt of ethylene diamine tetra-acetic acid, nitrilo triacetic acid (NTA), polyacrylates, phosphonates, oxalic acid, salt of oxalic acid, citric acid, salt of citric acid, zeolites, condensed phosphates, carbonates, polycarboxylates, and mixtures thereof; and (3) about 40 wt. % to about 95 wt. % water;

(4) about 0.1 wt. % to about 10 wt. % low temperature stabilizing agent comprising ethanolamine, wherein the low temperature stabilizing agent is provided in an amount sufficient to maintain stability of the liquid conditioner concentrate at a temperature as low as 40° F. for at least 4 weeks wherein stability is exhibited by a separate phase or layer that, if present, contains less then 5% of the total volume of the liquid conditioner concentrate;

(5) about 0.5 wt. % to about 10 wt. % fatty soap containing an alkyl group having between about 10 and about 20 carbon atoms.

18. A method according to claim 17, wherein the combination of anionic surfactant component and nonionic surfactant component provides a structured surfactant.

19. A method according to claim 17, wherein the anionic surfactant component comprises at least one of non-alkoxylated anionic surfactants and alkoxylated anionic surfactants.

20. A method according to claim 17, wherein the anionic surfactant component comprises at least one of alkyl benzene sulphonates, alkyl sulfates, secondary alkane sulphonates, alpha-olefin sulphonates, alkyl sulphocarboxylates, alkyl glyceryl ether sulphonates, fatty acid monoglyceride sulphates and sulphonates, fatty acid ester sulphonates, dialkyl sulphosuccinates, primary and secondary alkane sulphonates, soaps, alkyl ether sulphates, alkyl ether carboxylates, alkyl ether phosphates, alkali-metal salts of disulfonated alkyl ethers, alkyl phenyl ether disulfonic acids, and mixtures thereof.

21. A method according to claim 17, wherein the nonionic surfactant component comprises at least one of linear or branched alkyl alcohol ethoxylates, linear or branched alkyl phenol ethoxylates, alkyl polyglucosides, ethoxylated/propoxylated nonionic surfactants, amine oxides, alkyl polysaccharides, sugar ethers, betains, alkanolamides, fatty acid alkanolamides, ethoxylated alkanolamides, alkyl mercaptans, alkylene bisstearamides, ethoxylated alkanolamides, alkylene bis-palmitamides, capped ethylene oxide adducts of alkylphenols, primary alky alcohols, secondary alkyl alcohols, and mixtures thereof.

22. A method according to claim 21, wherein the linear or branched alcohol ethoxylates include those having between about 1 and about 20 ethylene oxide repeating units and an alkyl group containing between about 1 and about 20 carbon atoms, the linear or branched alkyl phenol ethoxylates include those having between about 1 and about 20 ethylene oxide repeating units and an alky group containing between about 1 and about 20 carbon atoms, and the alkyl polyglucosides include those having an alky group containing between about 8 and about 20 carbon atoms and a degree of polymerization of between 0 and about 10.

23. A method according to claim 17, wherein the low temperature stabilizing agent comprises at least one of monoethanolamine, diethanolamine, and triethanolamine.

24. A method according to claim 17, wherein the concentrate further comprises:

(a) at least one of cationic surfactants, amphoteric surfactants, anti-redeposition agents, optical brighteners, bleach activators, enzymes, dye-transfer inhibitors, alkaline agents, dyes, and fragrances.

25. A method according to claim 17, wherein splitting the concentrate between the first use solution and the second use solution provides enhanced cleaning compared with using the same amount of concentrate in only the first use solution.

26. A liquid conditioner concentrate according to claim 1, wherein the amount of the combination of anionic surfactant and nonionic surfactant to the water conditioning agent is between about 1:1 and about 1:8.

27. A conditioner use solution according to claim 9, wherein the amount of the combination of anionic surfactant and nonionic surfactant to the water conditioning agent is between about 1:1 and about 1:8.

28. A method according to claim 17, wherein the amount of the combination of anionic surfactant and nonionic surfactant to the water conditioning agent is between about 1:1 and about 1:8.

29. A method according to claim 17, further comprising:

(a) diluting the concentrate with water at a weight ratio of concentrate to water of between about 1:1 and about 1:10 to form a diluted concentrate.

30. A method according to claim 29, further comprising:

(a) further diluting the diluted concentrate at a weight ratio of diluted concentrate to water of between about 1:100 and about 1:2,000.

* * * * *